US005988058A

United States Patent [19]

Lee

[11] Patent Number: 5,988,058

[45] Date of Patent: Nov. 23, 1999

[54] WOOL ATTACHING MACHINE FOR CLOTH

[76] Inventor: Ching Huang Lee, 1Fl., No. 44, Lane 144, Sec. 2, Nan Ya South Rd., Pan Chiao City, Taipei Hsien, Taiwan

[21] Appl. No.: 09/002,172

[22] Filed: Dec. 31, 1997

[51] Int. Cl.[6] ..... B41F 15/00; B05D 1/14

[52] U.S. Cl. ..... 101/114; 8/445; 156/240; 428/90; 234/2; 427/206

[58] Field of Search ..... 101/114; 8/470, 8/445, 467, 468, 478, 488; 156/230, 235, 239, 240; 427/206, 207.1, 208.2, 208.4, 208.8; 428/88, 90; 234/2

[56] References Cited

U.S. PATENT DOCUMENTS

| | | | |
|---|---|---|---|
| 3,918,895 | 11/1975 | Mizuno | 101/470 |
| 3,956,552 | 5/1976 | Geary | 428/90 |
| 4,019,036 | 4/1977 | Hiramatsu et al. | 234/2 |
| 4,027,345 | 6/1977 | Fujisawa et al. | 101/470 |
| 4,201,810 | 5/1980 | Higashiguchi | 428/90 |
| 4,233,027 | 11/1980 | Albero | 8/488 |
| 4,314,813 | 2/1982 | Masaki | 156/235 |
| 4,742,699 | 5/1988 | Nakahara et al. | 101/119 |
| 5,160,505 | 11/1992 | Seveno et al. | 101/470 |
| 5,673,621 | 10/1997 | Vaughan | 101/126 |

*Primary Examiner*—Eugene Eickholt
*Attorney, Agent, or Firm*—Dougherty & Troxell

[57] ABSTRACT

A wool attaching machine for cloth is composed of a working table, a conveyer, a plurality of printing rollers, a bonding agent transfer device, a static electricity wool attaching device and a baking device. The conveyer is installed on the working table for delivering cloth, and the printing rollers are used for printing patterns on the cloth. The bonding agent transfer device has a bonding agent roller with stencil patterns, a strainer net attached closely to an inner surface of the stencil patterns, to enable bonding agent in the bonding agent roller to penetrate slowly from the strainer net through the stencil patterns onto the cloth to form bonding agent patterns. The static electricity wool attaching device is installed behind the bonding agent transfer device. As the cloth having the bonding agent patterns passes through the static electricity wool attaching device, the floating wool stored in this device is attracted into contact with the bonding agent pattern by means of static electricity to form wool patterns on the cloth. The wool attaching machine can produce printing patterns and wool patterns on cloth in a single manufacturing step.

4 Claims, 8 Drawing Sheets

WOOL ATTACHING MACHINE FOR CLOTH

BACKGROUND OF THE INVENTION

1. Field of the Invention

This invention relates to a wool attaching machine for cloth, especially a wool attaching machine which can produce printing patterns and wool attaching patterns on cloth in a single manufacturing step.

2. Description of the Prior Art

We always use a printing roller or cylinder to print various patterns on cloth in the past, but the conventional printing process can only provide a flat face pattern or figure. If we would like to get a convex pattern on cloth, we must use knitting or embroidering machines to produce a convex pattern. However, the conventional knitting or embroidering process takes too much time to get a convex pattern on cloth, furthermore, the conventional knitting or embroidering machine is very expensive and will raise the manufacturing cost.

On the other hand, the convex pattern made by the conventional knitting machine or embroidering machine may form a hard block on cloth that will reduce the softness of cloth. Furthermore, the edge cloth of the convex pattern may be torn easily.

Accordingly, a wool-attaching machine to make wool attached to an article surface has been developed, but the kind of wool-attaching machine can only produce a whole wool attaching surface, it can't produce a wool pattern or figure on cloth. Accordingly, the conventional wool attaching machine can't replace the knitting machine or embroidering machine to produce a wool pattern or figure.

SUMMARY OF THE INVENTION

It is therefore the main object of this invention to provide a wool attaching machine for cloth, in which the wool attaching machine can produce a printing pattern and wool attaching pattern simultaneously so as to replace the conventional knitting machine or embroidering machine.

It is the another objective of this invention to provide a wool attaching machine which is composed of a bonding agent transfer device and a static electricity wool attaching device, in which the bonding agent transfer device can spread bonding agent from stencil patterns to the cloth, and a floating wool stored in the static electricity wool attaching device can be attracted to attach on the bonding agent pattern by means of static electricity to form a wool pattern.

It is still another objective of this invention to provide a wool attaching machine which can be connected with a printing machine to reduce the manufacturing cost and time.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENTS

Figure 1:
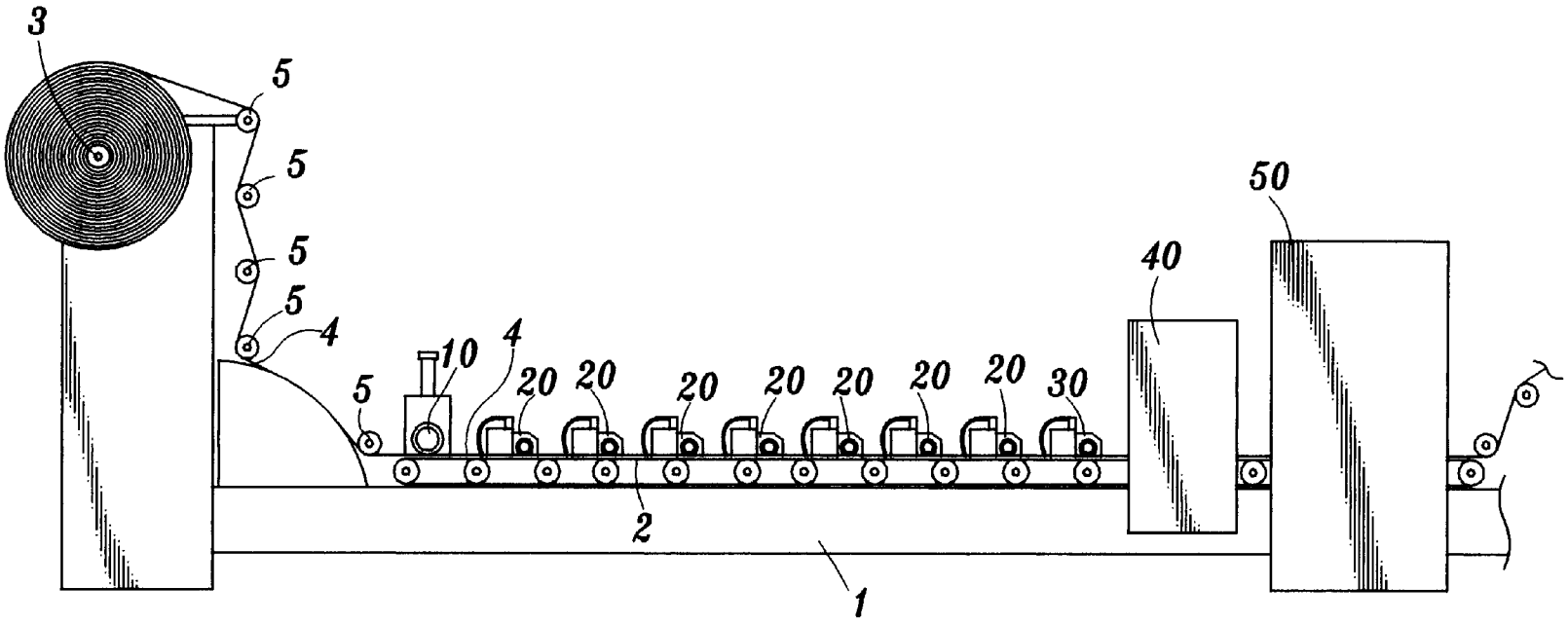
FIG. 1 is a side view showing a wool attaching machine for cloth according to the present invention.

Referring to FIG. 1, the present invention, a wool attaching machine for cloth, is composed of a working table 1, a conveyer 2 and a reel 3, the conveyer 2 being installed on the working table for winding and delivering cloth 4. The upper part of the working table 1 has a plurality of rollers 5 for leading cloth into the conveyer 2.

The working table 1 has a compression roller 10, a plurality of printing rollers 20, a bonding agent transfer device 30 and a static electricity wool attaching device 40 installed according to the delivery direction of cloth 4. as cloth 4 is delivered by the conveyer 2, it will pass through printing rollers 20, which can print various patterns on cloth 4, then the bonding agent transfer device 30, which can spread bonding agent on cloth 4, and last, the static electricity wool attaching device 40, in which wool is attached on the places having bonding agent by means of static electricity.

The end of the working table 1 has a baking device 50 for baking the completed cloth pattern and attaching wool. The structure of the printing roller 20 is the same as that of the conventional printing roller.

Figure 2:
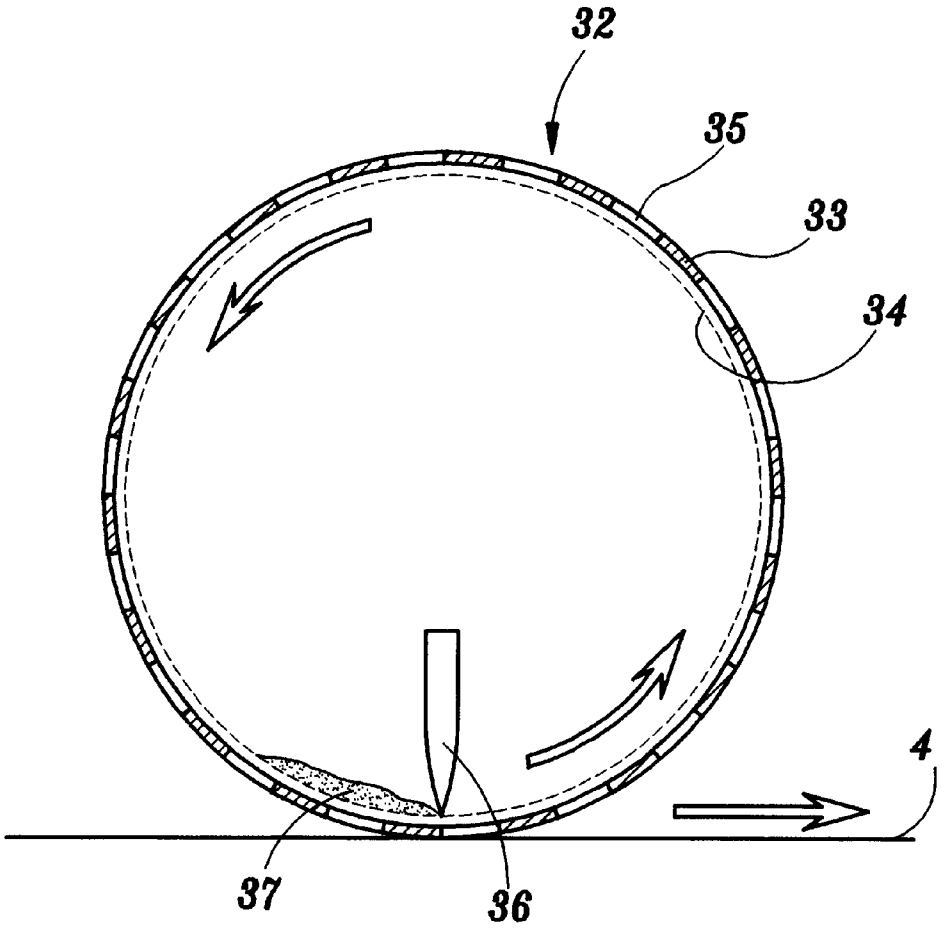
FIG. 2 is a partial sectional view showing a printing roller and a bonding agent transfer device of this invention.
Figure 3:
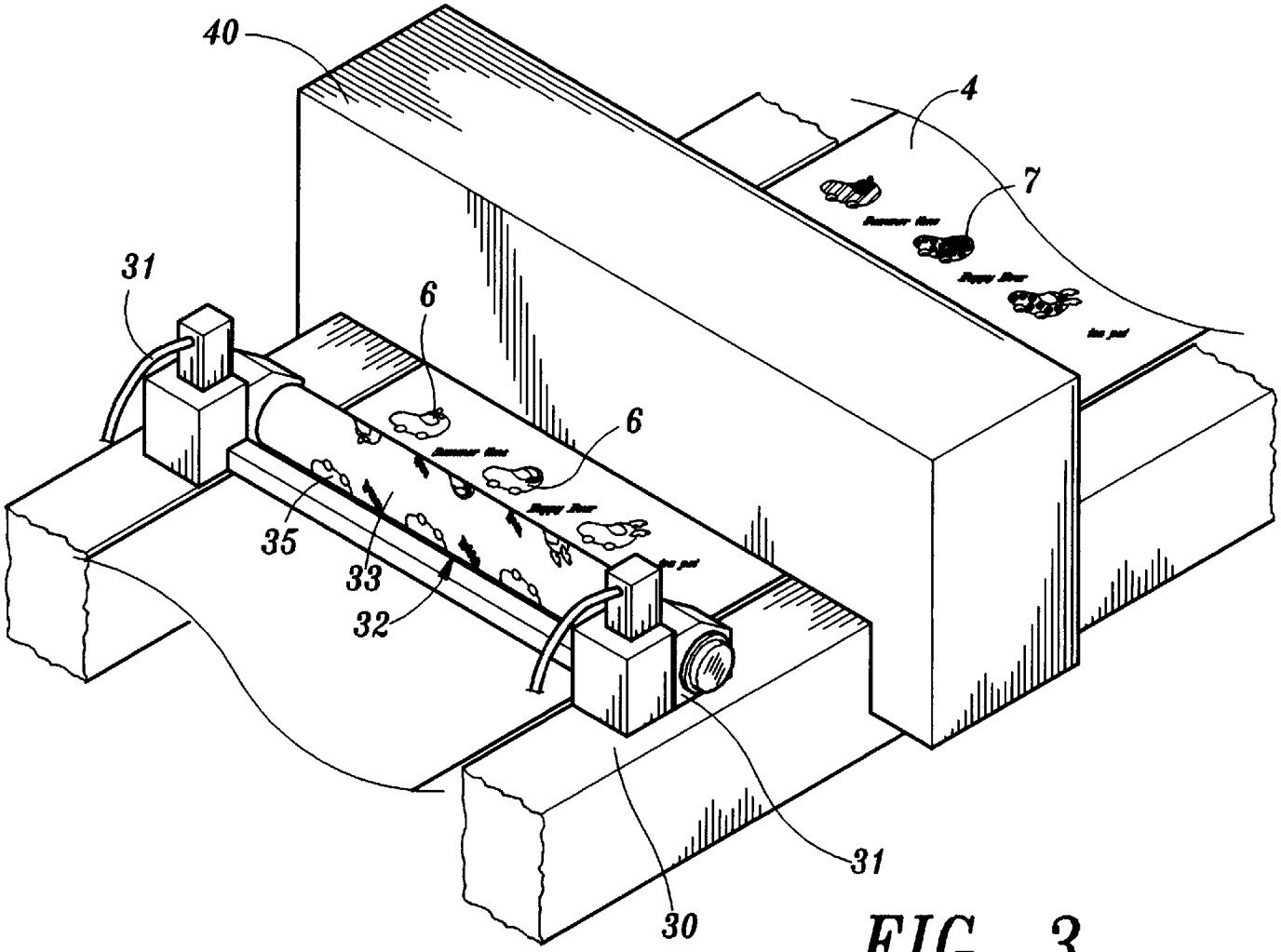
FIG. 3 is a partial perspective view showing the operation of a bonding agent roller of this invention.

Referring to FIG. 2 and 3, the bonding agent transfer device 30 is composed of two supporting seats 31 installed on opposite sides of the working table 1 and a bonding agent roller 32 installed on the two supporting seats 31 which can be rotated to touch the surface of cloth 4. The bonding agent roller 32 has a pattern cylinder 33, a strainer net 34 and a scraping cutter 36. The inner part of the pattern cylinder 33 is empty and the outer surface of the pattern cylinder 32 has a plurality of stencil patterns 35. The strainer net 34 is attached on the inner surface of the pattern cylinder 32, extending laterally in the pattern cylinder 32 and in contact with the strainer net 34.

The operator can put bonding agent 37 into the pattern cylinder 32 and the bonding agent 37 is spread uniformly on the strainer net 34 by means of the scraping cutter 36. Accordingly, bonding agent 37 can penetrate slowly from the strainer net 34 to the outer surface of the stencil pattern 35. Thus bonding agent 37 will be spread uniformly on the cloth surface from the stencil patterns 35 as the cloth 4 passes by the rotating pattern cylinder 32, such that, the cloth surface has formed thereon a plurality of bonding areas 6.

Referring to FIG. 3 again, when cloth 4 passes through the static electricity wool attaching device 40, a wool 46 stored in the static electricity wool attaching device 40 can attach to the bonding areas 6 of cloth 4 by means of static electricity to form a wool pattern 7.

Figure 4:
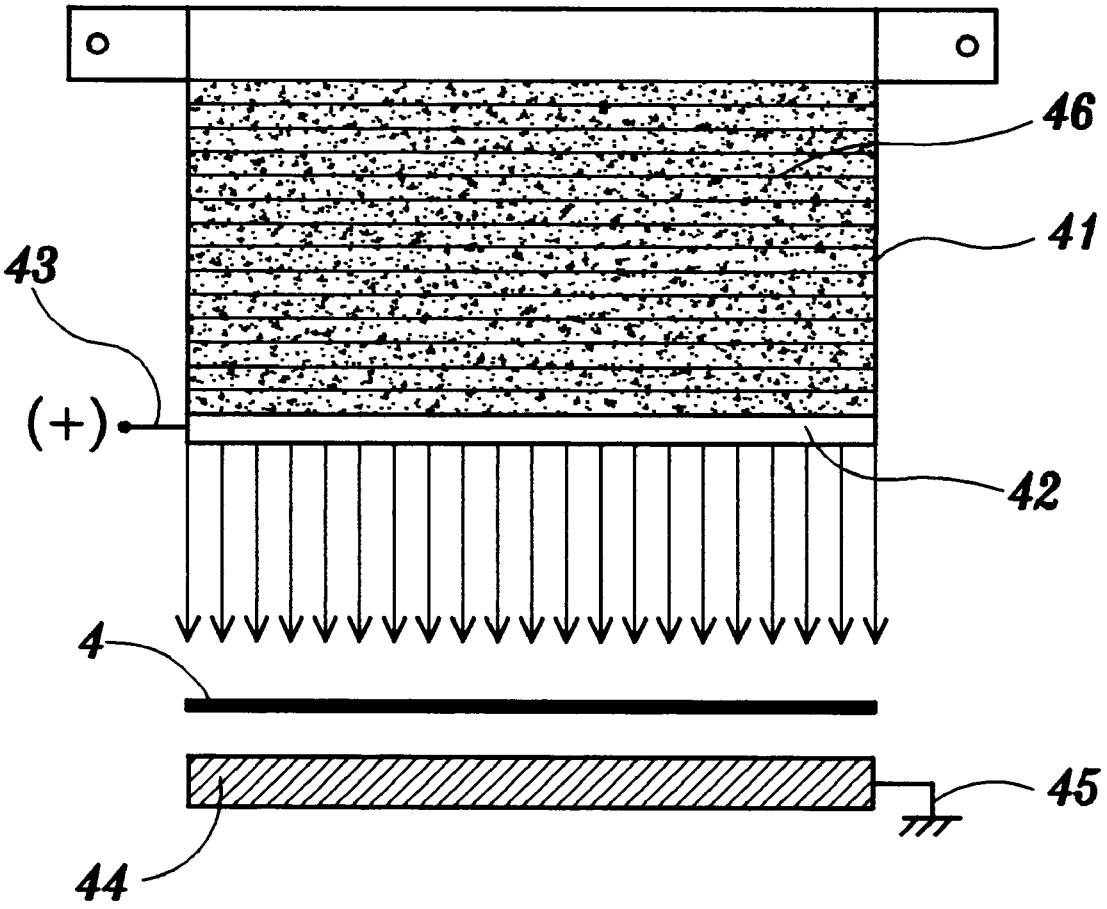
FIG. 4 is a plan view showing a static electricity wool attaching device.

Referring to FIG. 4, the static electricity wool attaching device 40 has an insulating container 41, a positive electrode 43, an electrode board 44 and a negative electrode 45. At the bottom of this insulating container 41 there is an aperture 42 facing the cloth surface. The positive electrode 43 is connected with the insulating container 41 to produce a positive charge. The electrode board 44 is installed under cloth 4 connected with the negative electrode 45 so as to make the passing cloth 4 on the electrode board 44 have a negative charge.

Inside the insulating container 41 is a floating wool 46. Because the insulating container 41 can produce a positive charge and the electrode board 44 can produce a negative charge, the wool 46 is attracted to the cloth surface by means of static electricity, such that, the wool 46 can attach to the bonding areas 6 to form wool patterns 7.

After cloth 4 passes through the printing and wool-attaching process, cloth 4 will move forward to the baking device 50, in which the printing pattern and the wool pattern 7 on cloth 4 can be baked evenly.

As to the material of wool pattern 46, we can use colored wool or other powder metal, even a flashing piece to form various bonding patterns, but these materials must be conductors.

Figure 5:
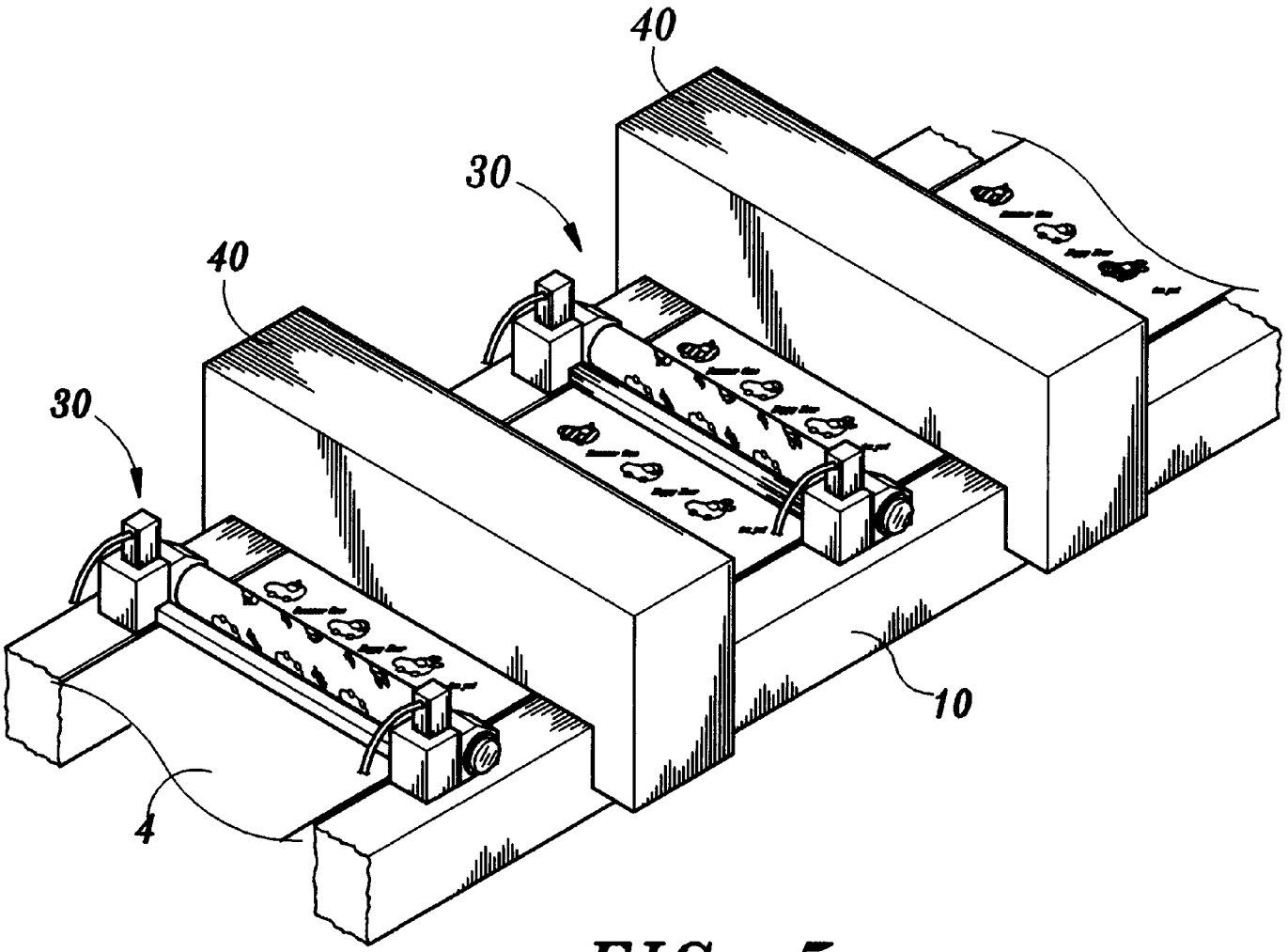
FIG. 5 is a perspective view showing another embodiment of this invention.

FIG. 5 shows another embodiment of this invention. In this embodiment, another bonding agent transfer device 30 and static electricity wool attaching device 40 are installed behind the original bonding agent transfer device 30 and static electricity wool attaching device 40. The second bonding agent transfer device 30 and static electricity wool attaching device 40 can produce a different printing pattern and wool pattern. Thus, this embodiment can produce two printing patterns and two wool patterns. Accordingly, we can install more bonding agent transfer devices 30 and static electricity wool-attaching devices 40 to produce more printing patterns and wool patterns.

Figure 6:
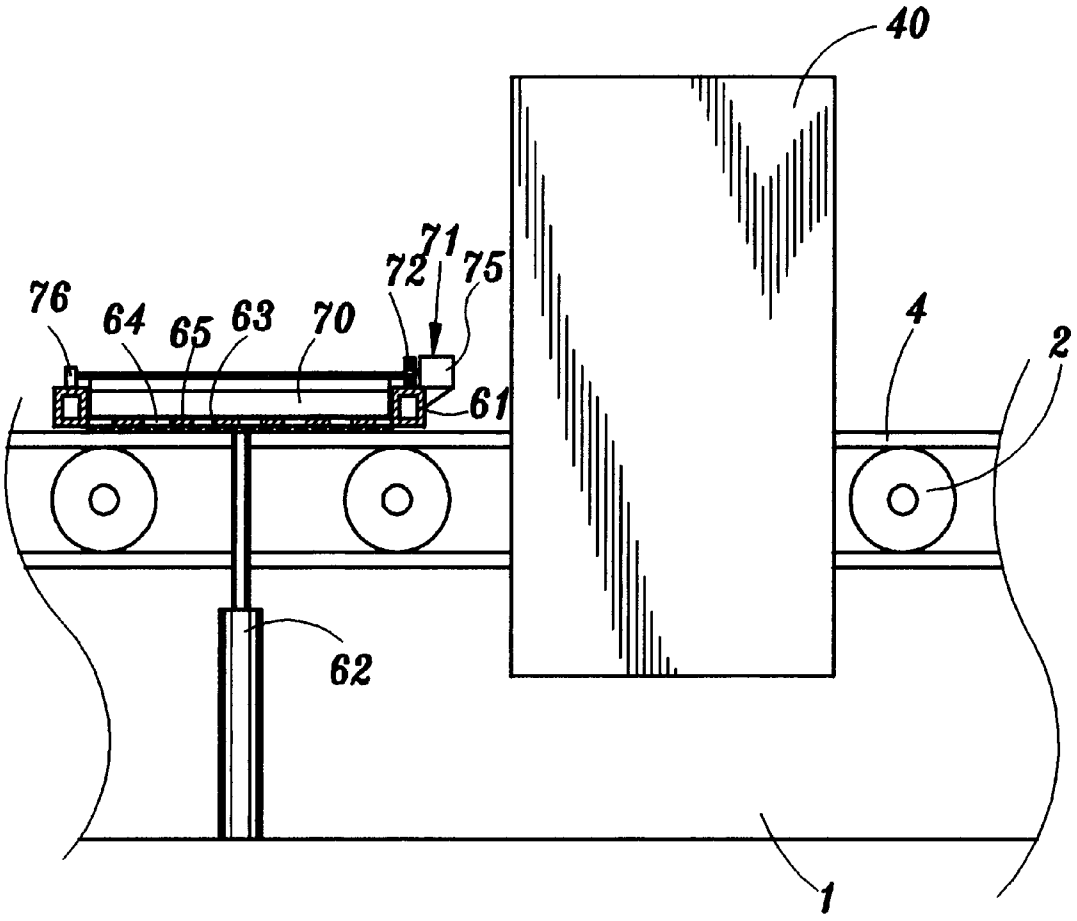
FIG. 6 is a partial side view showing still another embodiment of this invention.
Figure 7:
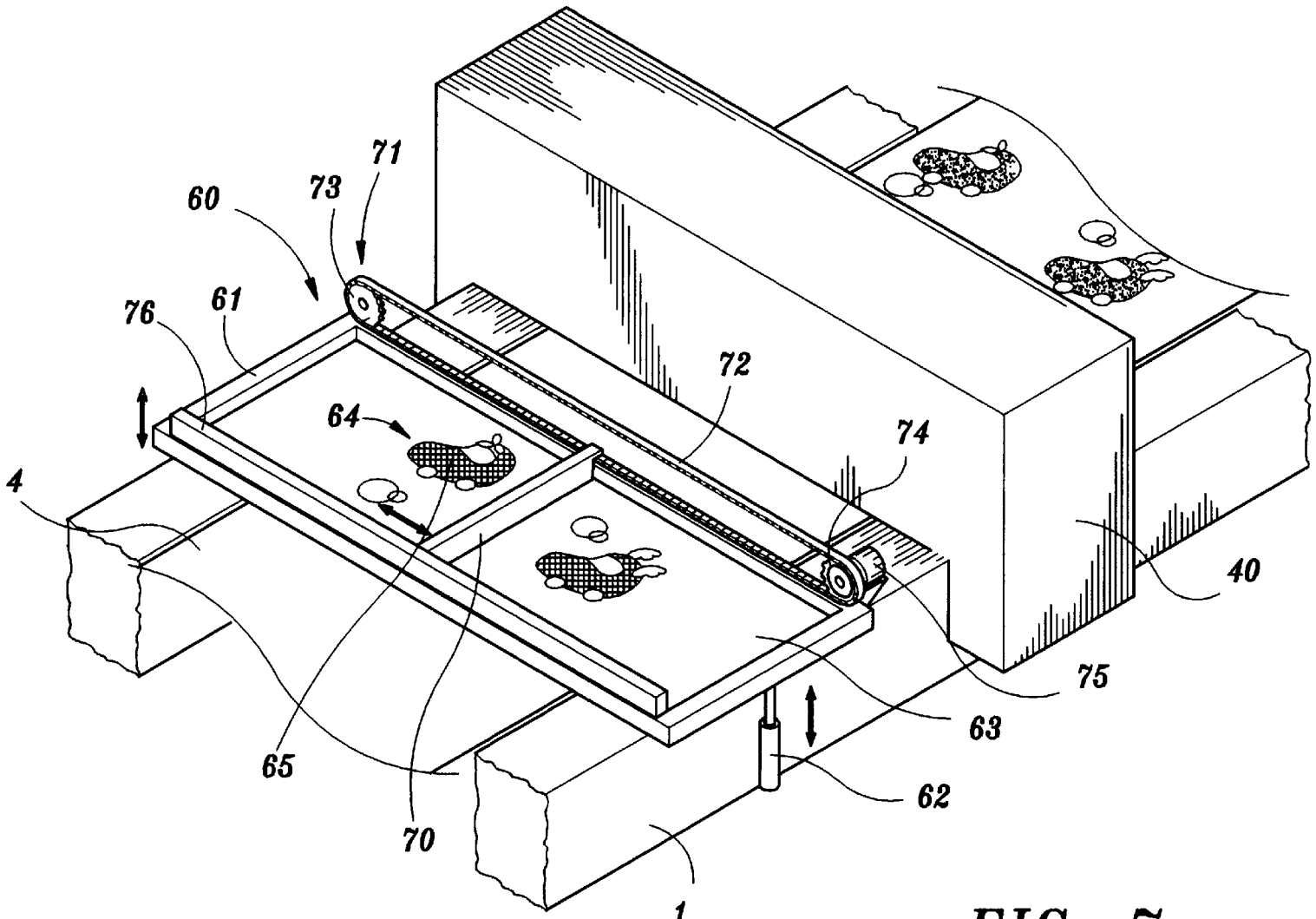
FIG. 7 is a partial perspective view showing the operation of the embodiment in FIG. 6.

FIG. 6 and FIG. 7 show still another embodiment of this invention. This embodiment has a plate bonding agent transfer device 60 to replace the original bonding agent transfer device 30. The plate bonding agent transfer device 60 is composed of a rectangular frame 61, a pair of lifting rods 62, a pattern plate 63, a filter net 65, a scraping plate 70 and a drive mechanism 71. The rectangular frame 61 is installed on the working table 1 and can be moved upwardly and downwardly by means of the pair of lifting rods 62 installed at two sides of the rectangular frame 61. The pattern plate 63 is installed under the rectangular frame 61, and has a plurality of stencil figures 64 formed at its surface. The filter net 65 is installed under the pattern plate 63. As bonding agent is put on the pattern plate 63, the bonding agent will penetrate slowly from the filter net 65 to the cloth 4.

The scraping plate 70 is installed on the rectangular frame 61 and contacts the pattern plate 63. The scraping plate 70 can be moved forwardly or backwardly along a guide rail 76 so as to scrape bonding agent on the pattern plate 63 evenly, such that, the bonding agent can penetrate slowly to the stencil FIG. 64 and cloth 4 by means of the filter net 65. The scraping plate 70 is driven by the drive mechanism driving chain 72, a driven chain wheel 73, a driving chain wheel 74 and a drive motor 75.

The rectangular frame 61 can be moved upwardly or downwardly by lifting rods 62. When the rectangular frame 61 moved downwardly, the pattern plate 63 and the filter net 65 will contact the cloth surface. Thus, bonding agent can penetrate slowly from the stencil FIG. 64 to spread on cloth surface. When the rectangular frame 61 is lifted upwardly, the pattern plate 63 will separate from the cloth surface. Accordingly, the rectangular frame 61 of this plate bonding agent transfer device 30 can be moved upwardly and downwardly by the lifting rods 62 to make the pattern plate 63 spread bonding agent intermediately from the stencil FIG. 64 on the passing cloth 4.

Although the production efficiency of this plate bonding agent transfer device 60 is lower than that of the original bonding agent transfer device 30, the plate bonding agent transfer device 60 can produce larger and longer distance bonding agent patterns than the bonding agent transfer device 30 in FIG. 1 to FIG. 5. Accordingly, the plate bonding agent transfer device 60 and the original bonding agent transfer device 30 can be used in different conditions to obtain the best results.

Figure 8:
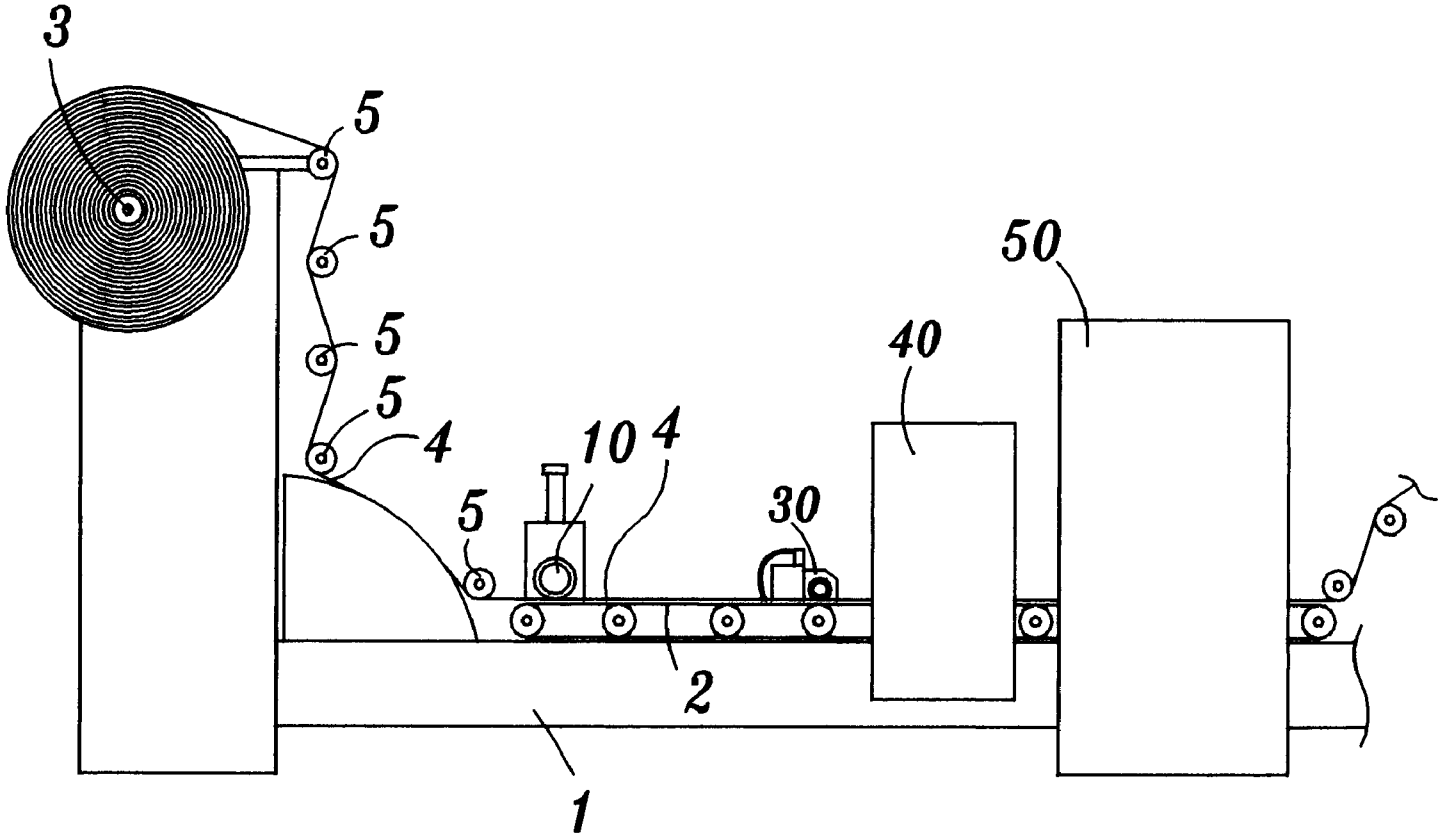
FIG. 8 is a side view showing still another embodiment of this invention.

The FIG. 8 shows still another embodiment of this invention, in which the bonding agent transfer device 30, the static electricity wool attaching device 40 and the baking device 50 are installed on the table 1 to form an independent wool attaching machine.

Accordingly, the present wool attaching machine for cloth can produce wool patterns on cloth by means of the bonding agent transfer device and the static electricity wool attaching device, and the wool can be attracted to attach to the bonding agent pattern by means of static electricity to form wool pattern on cloth. The present wool attaching machine can replace the conventional knitting machine or embroidering machine. Furthermore, the wool pattern made by the present invention can't influence the softness of cloth. The wool attaching machine for cloth also can be connected with the conventional printing machine so as to reduce the manufacturing cost and time.

It is understood by those skilled in the art that the foregoing description includes preferred embodiments of the disclosed device and that various changes and modifications may be made in the invention without departing from the spirit and scope thereof.

What is claimed is:

1. A wool attaching machine for cloth comprising:

a working table having a conveyer for delivering cloth;

a bonding agent transfer device installed on said working table for transferring a bonding agent in the form of a bonding agent pattern to a cloth surface;

a static electricity wool attaching device installed on said working table and situated behind said bonding agent transfer device, an inside of said static electricity wool attaching device having a floating wool which is attracted to attach on the bonding agent pattern by means of static electricity effect to form a wool pattern on the cloth;

a baking device installed at an end of said working table for baking said cloth pattern.

2. A wool attaching machine for cloth as claimed in claim 1, wherein the bonding agent transfer device is composed of two supporting seats installed opposite on said working table and a bonding agent roller installed on said two supporting seats, said bonding agent roller having a pattern cylinder, a strainer net and a scraping cutter, said pattern cylinder having a plurality of stencil patterns formed at its outer surface, said strainer net being installed closely to an inner surface of said stencil patterns, whereby said bonding agent on the bonding agent roller can penetrate from said strainer net through said stencil patterns to said cloth surface to form said bonding agent patterns, said scraping cutter being installed in said pattern cylinder for scraping bonding agent evenly on said strainer net.

3. A wool attaching machine for cloth as claimed in claim 1, wherein the bonding agent transfer device comprises a plate bonding agent transfer device, said plate bonding agent transfer device being composed of a rectangular frame, a pair of lifting rods, a pattern plate, a filter net, a scraping and a drive mechanism, said rectangular frame can be moved downwardly to contact said cloth surface or upwardly to separate from said cloth by means of said lifting rods, said pattern plate being installed under said rectangular frame and having a plurality of stencil figures formed at its surface, said filter net being attached close to said plate to make said bonding agent penetrate slowly from the filter net through said stencil figures to the cloth surface, said scraping plate being installed on said rectangular frame and driven by said drive mechanism for scraping bonding agent evenly on said filter net.

4. A wool attaching machine for cloth as claimed in claim 1, wherein the wool attaching machine for cloth is installed with at least one or more sets of bonding agent transfer device and static electricity wool attaching device.

* * * * *